US005195332A

United States Patent [19]

Sullivan

[11] Patent Number: 5,195,332

[45] Date of Patent: Mar. 23, 1993

[54] FAN COIL UNIT WITH NOVEL REMOVABLE CONDENSATE PAN

[76] Inventor: John T. Sullivan, 3910 Madison St., Hyattsville, Md. 20781

[21] Appl. No.: 760,538

[22] Filed: Sep. 16, 1991

[51] Int. Cl.[5] ..... F25D 21/14

[52] U.S. Cl. ..... 62/291; 62/205

[58] Field of Search ..... 62/285, 286, 288, 291, 62/272

[56] References Cited

U.S. PATENT DOCUMENTS

| | | | |
|---|---|---|---|
| 1,684,558 | 9/1928 | Schwarz | 62/288 |
| 2,210,725 | 8/1940 | MacMaster | 62/286 |
| 2,516,586 | 7/1950 | Peltier | 62/272 |
| 3,224,216 | 12/1965 | Crouch | 62/285 |
| 3,289,435 | 12/1966 | Herb et al. | 62/272 |
| 4,083,198 | 4/1978 | Dennis | 62/285 |
| 4,191,110 | 3/1980 | Klukos | 108/27 |
| 4,416,327 | 11/1983 | Nakada et al. | 165/122 |
| 4,609,511 | 9/1986 | Fischer et al. | 264/51 |
| 4,907,420 | 3/1990 | Mahanay et al. | 62/291 |
| 4,916,919 | 4/1990 | Kim | 62/272 |
| 4,941,901 | 7/1990 | Ramakrishan et al. | 62/262 |

*Primary Examiner*—Henry A. Bennet
*Assistant Examiner*—William C. Doerrler
*Attorney, Agent, or Firm*—Diller, Ramik & Wight

[57] ABSTRACT

A fan coil unit which includes a housing defining a chamber in which is located a condensation pan, and the condensation pan is snap-secured to a condensation tray mounting board and a fan board.

30 Claims, 5 Drawing Sheets

FAN COIL UNIT WITH NOVEL REMOVABLE CONDENSATE PAN

BACKGROUND OF THE INVENTION

Residential and commercial air conditioners include as a part thereof a fan coil unit. The fan coil unit includes a coil through which coolant (liquid or gas) is pumped, and normally the coil is spaced above or seated in a convector tray or condensation tray or pan in which condensation collects as air passes through the coil and condenses upon the exterior thereof. The condensate drips from the coil into the condensation tray and is conducted by an appropriate outlet(s) and pipe(s) to a conventional drain.

Such condensation pans are generally made from galvanized metal and rust with relative ease. Disadvantages of the latter and the manner in which the same are overcome through the construction of an in situ vacuum molded polymeric/copolymeric condensation tray are set forth in U.S. Pat. No. 4,856,672 dated Aug. 15, 1989 in the name of John T. Sullivan. However, though the condensation pan of the latter patent possesses many advantages, one disadvantage is the necessity of using separate and removable fasteners/connectors, such as nuts and bolts, to assemble and disassemble the condensation pan relative to the associated fan coil unit.

Additional novel and unobvious condensation pans/-trays are disclosed in U.S. Pat. No. 4,986,087 issued on Jan. 22, 1991 in the name of John T. Sullivan. The condensation pan of the latter patent is more readily installed within and removed from the fan coil unit through the sliding connections between the two. However, the sliding connections necessitate expensive molds for fabrication purposes which in turn necessitate increased cost of each condensation tray. Accordingly, the industry not only requires a condensation tray which includes all of the advantages heretofore noted in the latter-identified patents, but such condensation pan must be cost-effective and price competitive.

SUMMARY OF THE INVENTION

In keeping with the present invention, a condensation pan is provided for fan coil units of air conditioners/-heat exchangers, and includes an elongated pan body having opposite sides each of which includes a hook. The pan body can be made from extruded material, such as polymeric/copolymeric resin, metal or the like, or can be made from sheet metal. If the pan body is formed from extruded material, the hooks are integrally formed during the extrusion process and the pan body is closed by bonding or otherwise securing end caps or walls thereto. If the condensation body is formed from nonextruded metal, be it galvanized metal or stainless steel, the metal is simply bent to form the hooks and the end walls can be a separate or integral part of the stamping, as is conventional. However, in each case the fan coil unit is provided with a condensation tray mounting board and a fan board between which is defined an elongated gap, and it is generally within the elongated gap that the condensation pan is mounted by the hooks thereof and associated hooks of the condensation tray mounting board and the fan board. The latter hooks provide snap-securement between the condensation tray on the one hand and the fan board and condensation tray mounting board on the other, and thus the latter components can be readily assembled and disassembled in the absence of any separate fasteners (nuts and/or bolts) and in the absence of any tools whatever, such as screwdrivers, pliers, wrenches or the like. In this manner a removable front wall of the fan coil unit need not be removed to gain access to the condensation pan, and the latter can be quickly unsnapped from the condensation tray mounting board and the fan board to effect the removal of the condensation pan from the fan coil unit for inspection, repair and/or replacement. Obviously, the same snap-securement in the absence of any type of added fastening means can be achieved in a relatively straightforward and rapid manner.

In keeping with the foregoing, the condensation pan is provided with hooks extending along each of opposite generally parallel upper edges with the hooks either opening in the same direction or opposite directions, depending upon design efficiencies and mounting board/fan board characteristics. In one case the design of the fan coil unit structure might be such as to more readily accommodate hooks opening in the same direction rather than opposite directions, or vice versa, while alternating the opening direction of the hooks is also another variation. However, the only important factor is that of designing the hooks to achieve optimum securement of the condensation pan to the condensation pan mounting board and the fan board, while at the same time permitting rapid removal thereof.

In further accordance with the present invention, the condensation pan may itself have a hollow body with a chamber between interior and exterior surfaces, as disclosed in pending application Ser. No. 07/734,716 filed Jul. 23, 1991 in the name of John T. Sullivan, and now U.S. Pat. No. 5,174,467. The chamber or chambers of such a hollow condensation pan or hollow condensation pan body can be filled, if desired, with insulation. Thus, if the chambers are maintained hollow, condensation will form therein whereas if the chambers are filled with insulation, condensation will be reduced or eliminated on the exterior surface of the condensation pan/-body.

Also in accordance with this invention, the pan board carries a threaded nut at each end into which a wing bolt is threaded after passing through an associated vertical slot in a side wall of the fan coil unit. The latter construction allows the fan board to be adjusted to vary the size of the latter-mentioned elongated gap to make certain that the condensation pan is securely snapped secured between the condensation pan mounting board and the fan board.

In further keeping with the present invention, the condensation pan has slid upon the exterior thereof from either of axial ends a reinforcing/rigidifying bracket which is positioned generally medially between the ends of the condensation pan. Once this rigidifying or reinforcing bracket is slipped upon the condensation pan, the end caps or walls are bonded or otherwise secured thereto. The rigidifying/reinforcing bracket is particularly advantageous in the case of polymeric/-copolymeric resin extruded condensation pans which are relatively long (8 feet, for example), and tend to deform or deflect with use and over time. However, the rigidifying/reinforcing bracket generally prevents such deflection and extends the life of the condensation pan.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
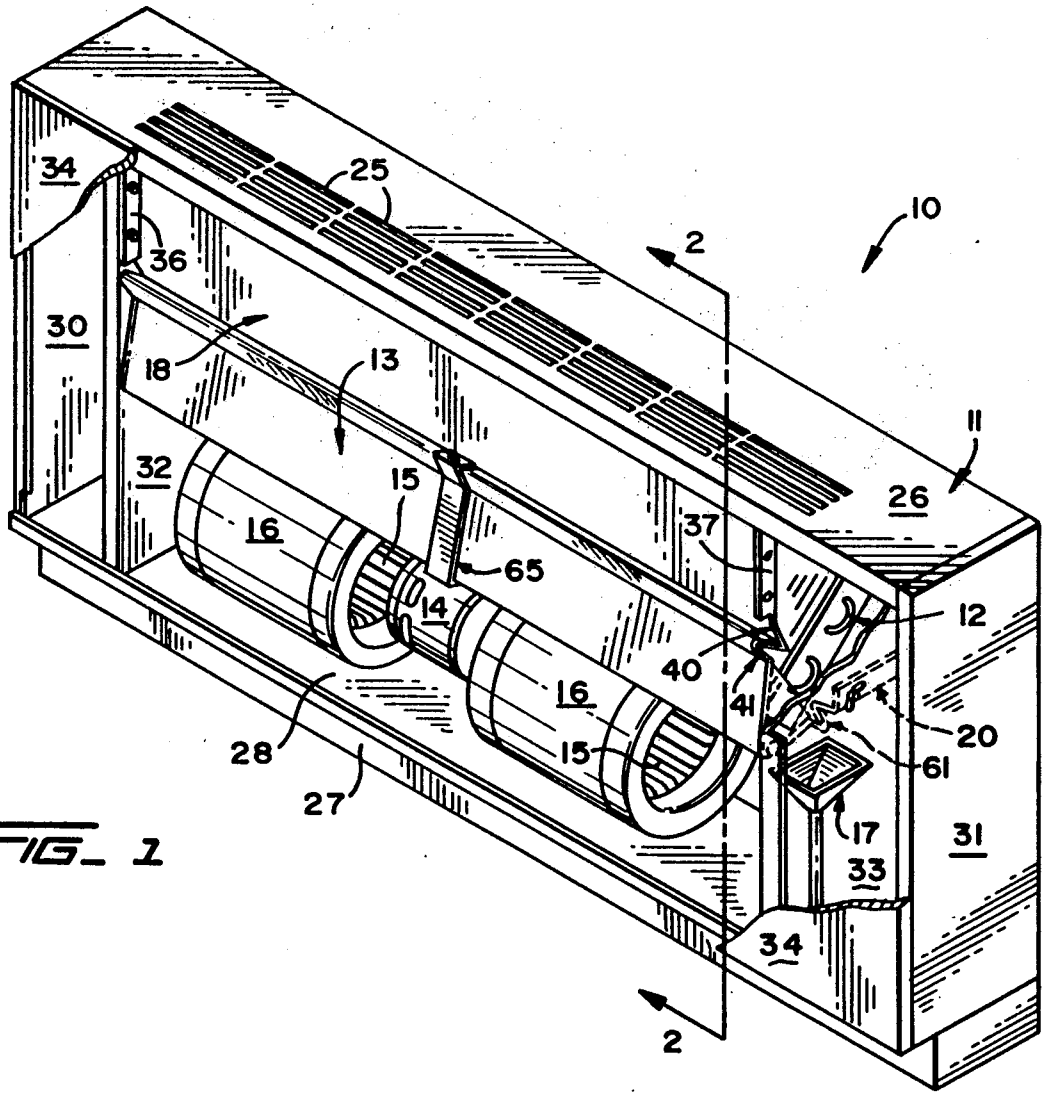
FIG. 1 is a perspective view of a novel fan coil unit of the present invention, and illustrates a condensation pan/tray snap-secured by opposite hooks to and between a condensation pan mounting board and a fan mounting board with the latter supporting a fan motor and a pair of fans and their associated housings.
Figure 2:
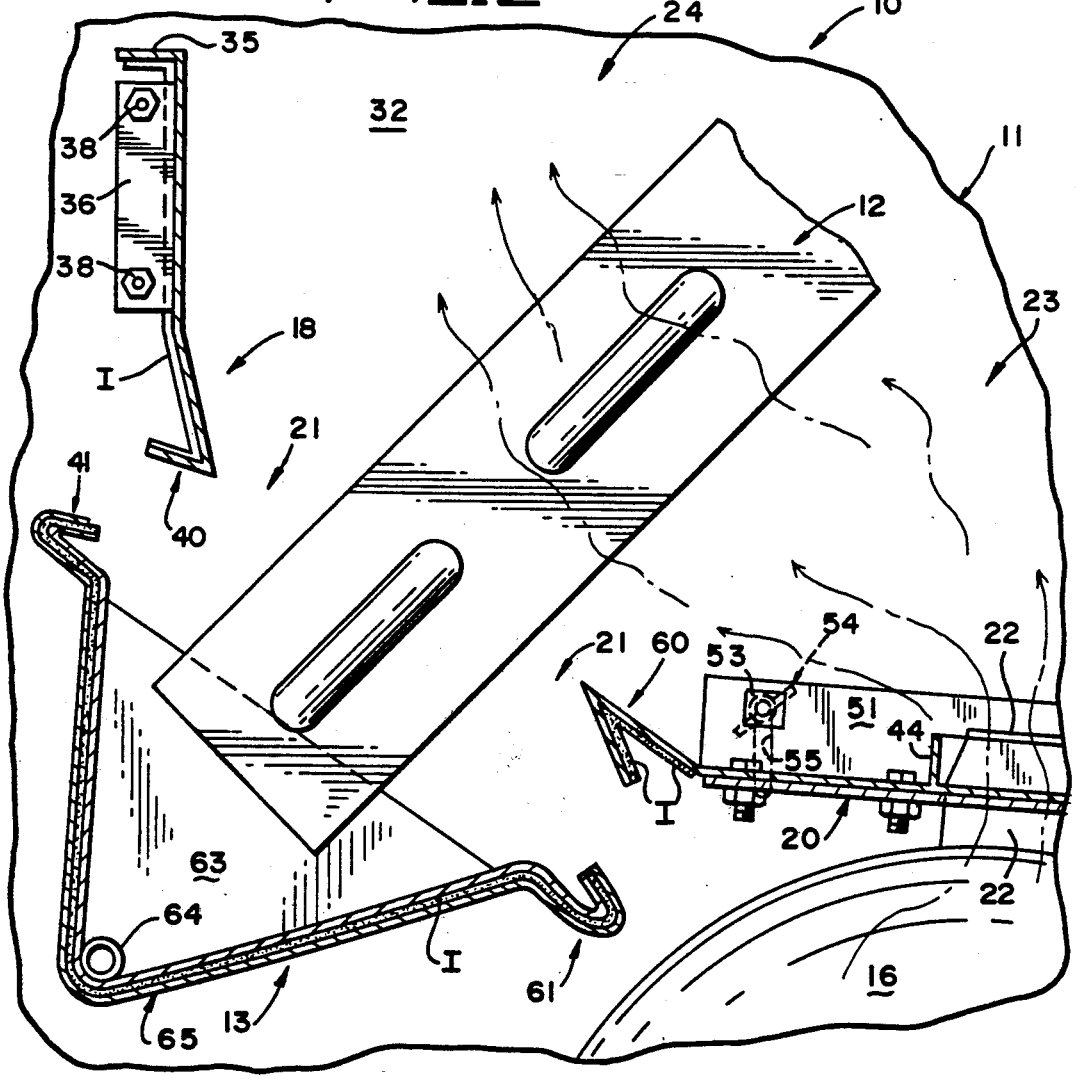
FIG. 2 is an enlarged fragmentary cross-sectional view taken generally along line 2—2 of FIG. 1 with parts removed for clarity, and illustrates the condensation pan and two of its associated hooks prior to being assembled to two hooks carried one each by the condensation pan mounting board and the fan board.

A novel fan coil unit is illustrated in FIG. 1 of the drawings, and is generally designated by the reference numeral 10. The fan coil unit 10 includes a housing a condensation/evaporation coil 12 (FIGS. 1 and 2), a primary condensation pan or tray or convector tray 13, a motor 14 (FIG. 1) for rotating fans 15 housed in housings 16, a secondary pan 17, a condensation tray or pan mounting board 18 and a fan board 20 (FIG. 2). The condensation tray mounting board 18 is spaced from the fan board 20 and defines therebetween a generally elongated gap 21 which is normally closed by the condensation tray 13. The motor 14 is supported from and beneath the fan board 20, along with the housings 16, 16, and air drawn into the housings 16, 16 during rotation of the fans 15 by the motor 14 is directed through fan housing outlets 22 (FIG. 2) into a lower chamber 23 of the housing 11 beneath the coil 12. The air flows through the coil 12, as indicated by the dash-dot headed unnumbered arrows in FIG. 2 entering an upper chamber 24 of the housing 11 and exiting the same through a plurality of elongated openings or slits 25 in a top wall 26 (FIG. 1) of the housing 11.

In addition to the top wall 26, the housing 11 includes a base or lower wall 27 having an opening (not shown) centrally located thereof within the housing 11 through which ambient air can be drawn by the fans 15 into the housing through a filter 28 prior to being drawn into the housing 11 and exiting the fan housing outlets 22 into the lower chamber 23. The housing 11 also includes opposite outer sides or side walls 30, 31, inner sides or side walls 32, 33 and a front wall 34. The front wall 34 is readily removed from and assembled to the housing 11 to gain access to the interior of the housing 11 in a conventional manner.

The condensation tray mounting board 18 is a relatively elongated metallic sheet having an upper flange 35 (FIG. 2) running the length thereof and opposite end or side flanges 36, 37 which are secured by nuts and bolts or similar conventional fastener means 38 to the inner side walls 32, 33, respectively, as is best illustrated in FIG. 2. A lowermost edge 40 of the condensation tray mounting board 18 is bent upon itself to define an acute angle and functions to cooperatively snap-secure to and from snap-securing means 41 (FIG. 2) of the condensation tray 18 in a manner which will be described more fully hereinafter.

Figure 4:
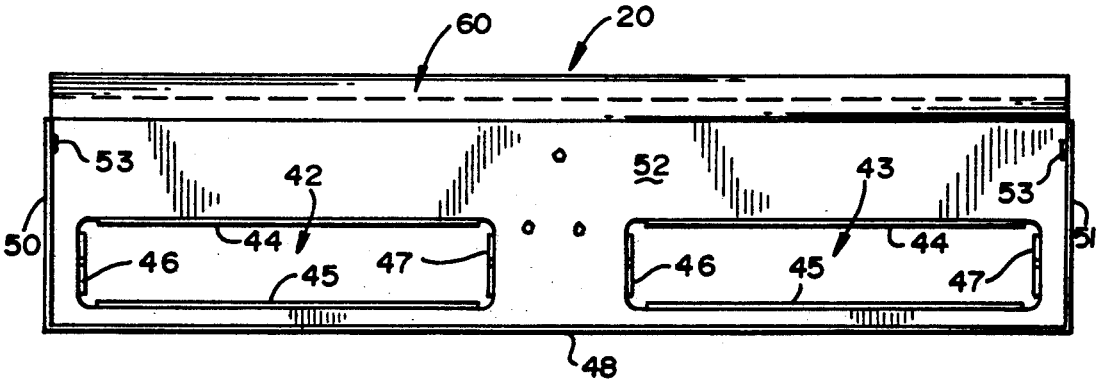
FIG. 4 is a top plan view of the fan board, and illustrates two generally polygonal openings bounded by walls for snap-securing the fan housings thereto and an elongated hook along one side of the fan board.

The fan board 20 (FIGS. 2 and 4) is a generally polygonally shaped sheet metal member having two polygonally shaped openings 42, 43, each defined by four upstanding flanges 44 through 47 to which the fan housing outlets 22 of the housings 16 are snap-secured in the manner disclosed in U.S. Pat. No. 4,986,087, the details of which are incorporated hereat by reference. The fan board 20 includes an upstanding elongated rear flange 48 and opposite generally parallel upstanding side flanges 50, 51 each having spot welded thereto an internally threaded nut 53 which is axially aligned with an opening (unnumbered) in the flanges 50, 51. An elongated edge of the fan board 20 is also bent upon itself to set off an acute angle, and therewith define cooperative snap-securing means 60 for cooperative engagement with snap-securing means 61 (FIG. 2) of the condensation tray 18.

A bottom wall 52 of the fan board 20 adjacent the rear flange 48 rests upon a plurality of ledges struck inwardly (not shown) from a rear wall (not shown) of the housing 11 opposite the front wall 34 thereof. Thus, the entire length of the fan board 20 along the flange 48 is supported generally along the bottom of the flange 48 by the latter ledges, while the forward portion of the fan board 20 is supported by wing bolts 54 which each passes through a slot 55 of each of the inner side walls 32, 33 and is each threaded into one of the two threaded nuts 53. When the wing bolts 54 are loose, the fan board 20 can be adjusted up or down along the length of the slots 54, as is most readily apparent from FIG. 2, to vary the position and distance between the cooperative means 40, 60 and thereby vary the size of the elongated gap 21 therebetween. The latter adjustment assures that the means 40, 41 and 60, 61 will readily snap-secure to each other and from each other to respectively mount and demount the condensation tray 13 within the gap 21.

Figure 3:
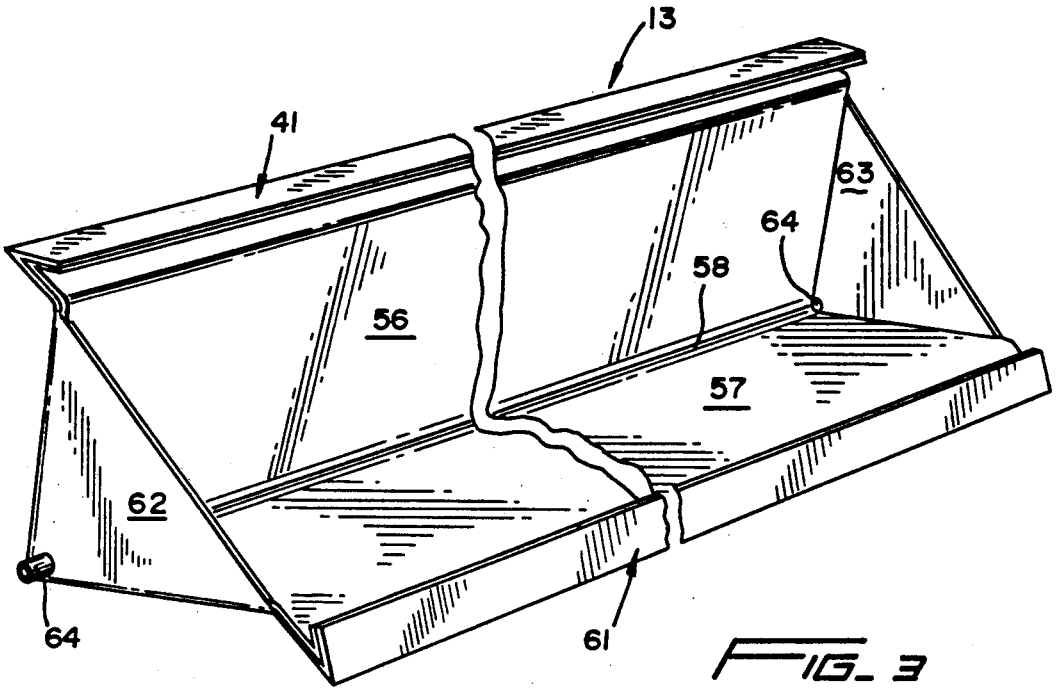
FIG. 3 is a fragmentary perspective view of the condensation pan of FIG. 2, and illustrates the overall construction thereof including a pan body, opposite end walls, a discharge opening in each end wall and a hook along opposite side walls with the hooks opening toward each other.

The condensation tray 13 (FIG. 3) is constructed from metallic sheet metal and includes body walls 56, 57 joined along an apex portion 58 and having bonded at opposite ends end walls 62, 63 of a generally triangular configuration with each having an opening (unnumbered) to which is connected an outlet or drain port 64 which directs condensation from the condensation tray 13 into the secondary pan 17 in a conventional manner. The means 41, 61 of the condensation tray 13 (FIGS. 2 and 3) are hooks which open toward each other, and the same are resilient due to the resilient nature of the material from which the condensation tray 13 is constructed. The means 40, 60 are also relative resilient, again because of the resilient nature of the metallic material from which the same are constructed. Accordingly, the means 40, 41 and 60, 61, respectively, can be readily relatively deflected and snap-secured to each other (FIG. 1) or deflected to unsnap the same from each other to rapidly remove and/or replace the condensation tray 13 relative to the coil 12 which, of course, is supported upon the walls 56, 57 of the condensation tray 13 when the latter is in its operative position (FIG. 1).

The means 40, 41 and 60, 61 constitute the sole means for securing the condensation tray or pan 13 to the housing 11. Accordingly, in order to remove the condensation tray 13, it is not necessary to remove the front wall 34 (FIG. 1), and snap unsecure the means 40, 41 and 60, 61 which permits the entire condensation tray 13 to be bodily removed, inspected, repaired and/or replaced by again merely snap-securing together the cooperative means 40, 41 and 60, 61.

Since the condensation tray 13 can be relatively long (8 feet, for example), means generally designated by the reference numeral 65 is slid externally upon the condensation tray 13 prior to attaching the end walls 62, 63. The means 65 is a metallic reinforcing bracket having an exterior cross-sectional configuration corresponding to the exterior transverse cross-sectional shape (FIG. 2) of the condensation tray 13. Thus, when the rigidifying bracket 65 is slipped upon and located generally medially of the ends of the condensation tray 13, as shown in FIG. 1, the condensation tray 13 is effectively rigidified and will maintain its relative position with respect to the coil 12, the condensation tray mounting board 18 and the fan board 20. Of course, the inner locking of the snap-securing means 40, 41 and 60, 61 also lends longitudinal rigidity to the overall length of the condensation tray 13 when in its assembled/snap-secured position (FIG. 1).

During the air conditioning phase of the operation of the fan coil unit 10, condensation collects upon the coil 12 and drips into and drains from the condensation tray 13, as is well known. Furthermore, there is a difference in ambient temperature above the condensation tray 13, the condensation tray mounting board 18 and the fan board 20, as opposed to the temperature therebelow. In order to reduce/preclude the formation of condensation on the underside of the condensation tray mounting board 18, the fan board 20 and the condensation tray 13, the latter three elements are provided with a sheet of insulation I upon the underside thereof (FIG. 2).

As is most apparent from FIG. 2, the snap-securing means or hooks 41, 61 open toward each other or in opposite directions, but variations thereof can be made in keeping with the present invention. For example, in FIG. 5*a* which appears on the sheet of drawings containing FIG. 2, the hooks or snap-securing means 41*a*, 61*a* open in the same direction and means 60*a* no longer is bent upon itself but projects upwardly to accommodate the hook 61*a*. A coil 12*a* subsequently resting upon the condensation pan 13*a* readily holds the securing means 60*a*, 61*a* interlocked together with the means 40*a*, 41*a* snap-secured to each other to hold the condensation tray 13*a* in assembled relationship.

Figure 5A:
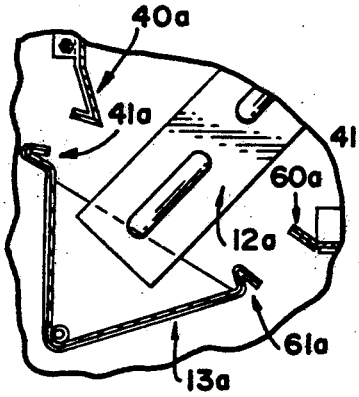
FIGS. 5*a* through 5*c* which appear on the sheet of drawing containing FIG. 2 are reduced cross-sectional views similar to FIG. 2, but illustrate three different condensation pans each having two hooks with different relative orientations.
Figure 5B:
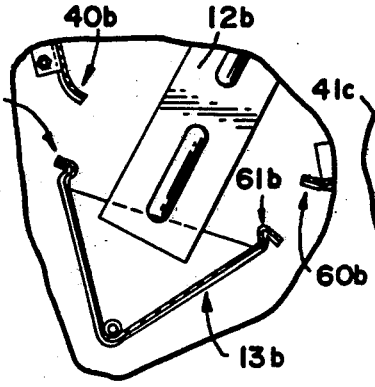

In FIG. 5*b* hooks or snap-securing means 41*b*, 61*b* open in opposite directions or away from each other, and cooperative securing means 40*b*, 60*b* also are not bent upon themselves but are directed more toward each other to snap-secure therebetween the means 41*b*, 61*b*.

Figure 5C:
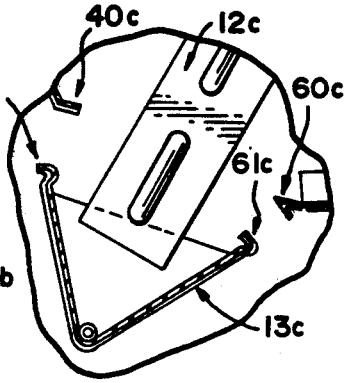

In FIG. 5*c* the relationship of the means 40*c*, 41*c* and 60*c*, 61*c* is essentially opposite that illustrated in FIG. 5*a*.

Collectively, FIGS. 2 and 5*a* through 5*c* represent examples of cooperative snap-securing means which can be utilized in the absence of any additional fastening means of any type to maintain the various condensation trays in assembled relationship between the condensation tray mounting boards and fan boards thereof.

Figure 6:
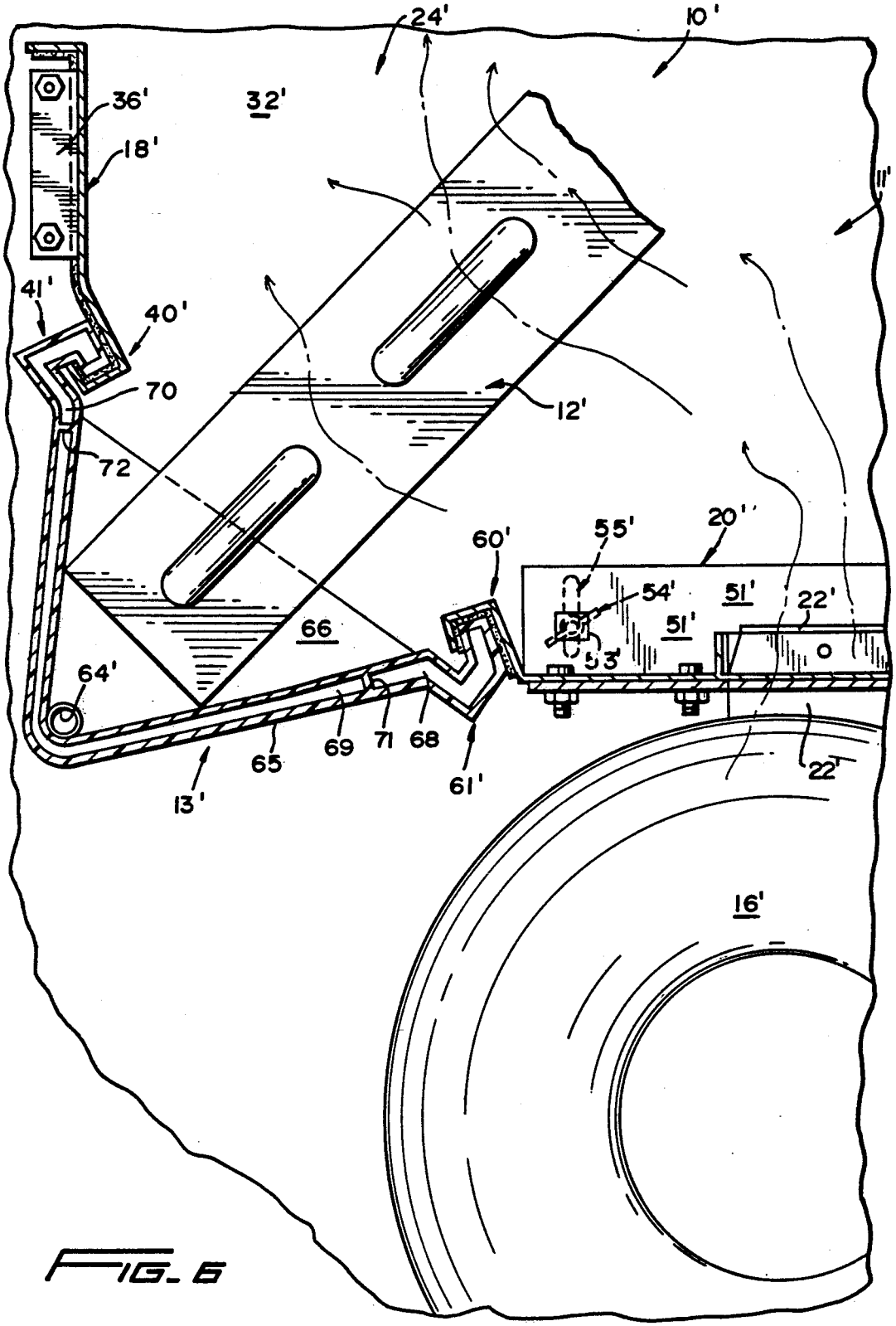
FIG. 6 is a fragmentary cross-sectional view similar to FIG. 2, and illustrates another condensation pan constructed from extruded polymeric/copolymeric resinous material, and illustrates a chamber between inner and outer walls thereof in which condensation can collect.

Reference is now made to FIG. 6 of the drawings which illustrates a fan coil unit 10' generally identical to the fan coil unit 10 and, therefore, includes identical though primed reference numerals. The fan coil unit 10' includes a coil 12', a condensation tray mounting board 18' and a fan board 20' corresponding to the respective coil 12, condensation tray mounting board 18 and fan board 20 of the fan coil unit 10. However, in lieu of the condensation tray 13, the fan coil unit 10' includes a condensation tray or pan 13' which includes a tray body 65 of a hollow extruded plastic construction formed in the manner described in U.S. patent application Ser. No. 07/681,234 in the name of John T. Sullivan, and now U.S. Pat. No. 5,071,027, the subject matter of which is hereat incorporated by reference.

Opposite end caps or walls 66, of which only one is illustrated, are sonically, adhesively or otherwise bonded to the hollow extruded body 65 after the formation of the latter. The hollow construction of the body 65 allows condensation to collect in various chambers 68 through 70 thereof which are separated by longitudinally extending reinforcing walls 71, 72. Any such condensation collected in the chambers 68 through 70 will, of course, flow into reservoirs (not shown) between the body 65 and end caps 66 and eventually discharge therefrom through one or both of opposite ones of drain ports 64'.

Figure 9:
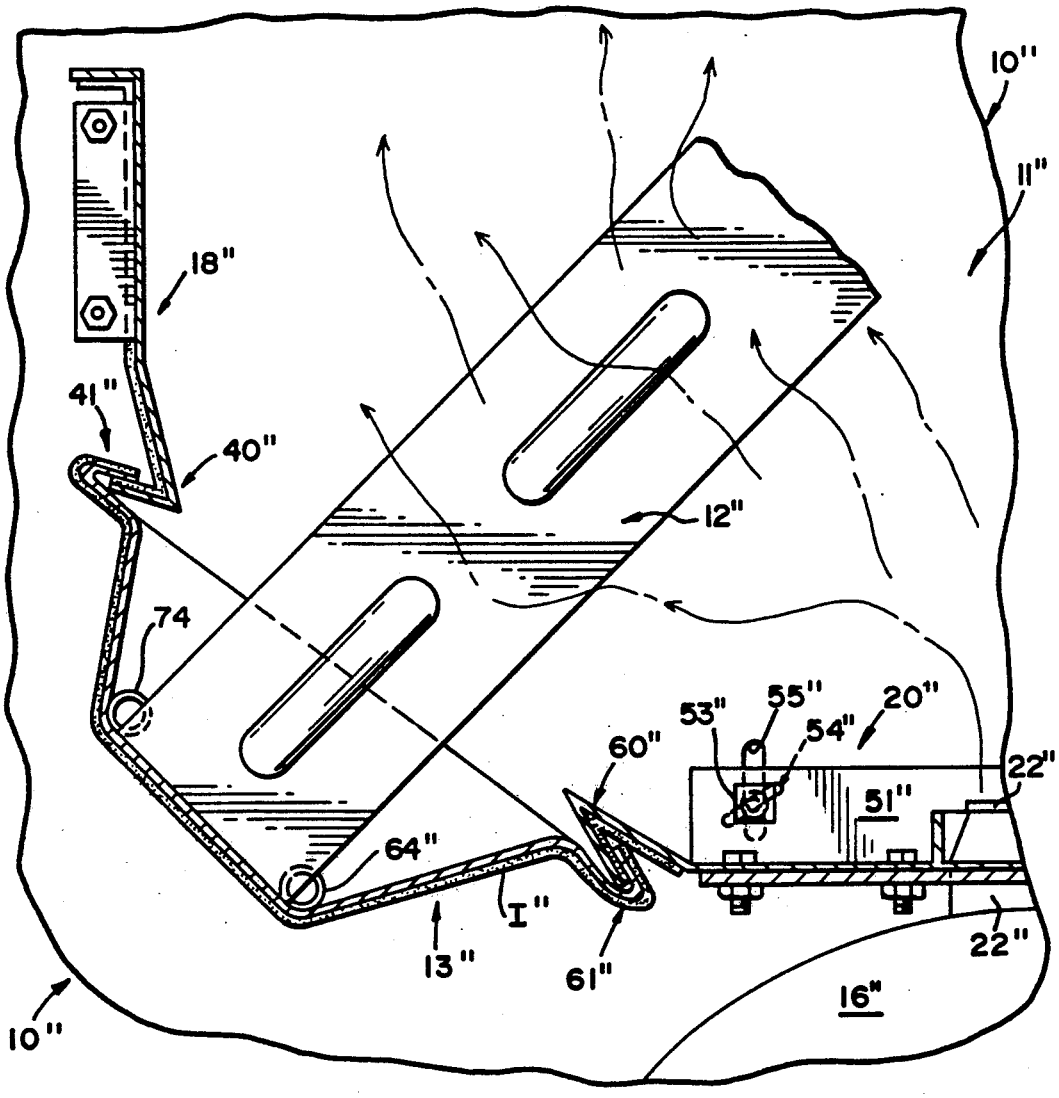
FIG. 9 is a fragmentary cross-sectional view of another fan coil unit similar to that illustrated in FIG. 2, but illustrates a pair of condensation outlets associated with each end of the condensation pan for utilization of the same alternatively as a ceiling or a floor mounted unit.

Another novel fan coil unit 10" is illustrated in FIG. 9, and components thereof identical to those of the fan coil unit i0 have been identically numbered, though double primed. The fan coil unit 10 " is designed for mounting in an upright or vertical position, as shown in FIG. 9, in which case condensate collected in a condensation tray 13" will discharge therefrom through a drain port 64". However, in addition to the drain port 64", the condensation tray 13" includes another one or pairs of opposite drain ports 74 which will discharge condensate from the condensate tray 13" when the latter is mounted in a horizontal position, as, for example, in a ceiling or wall. In the latter case, the entire fan coil unit 10" would be mounted in a position corresponding to FIG. 9 rotated counterclockwise 90 degrees which places the drain port(s) 74 lowermost, thus collecting and draining condensate forming upon and off the coil 12" and flowing into the condensation tray 13".

Figure 7:
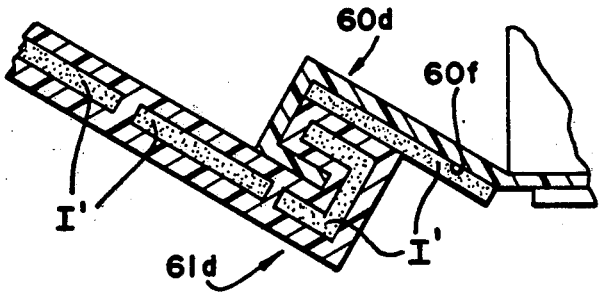
FIG. 7 is a fragmentary cross-sectional view of one edge of another condensation pan, and illustrates chambers thereof filled with insulating material.

Reference is made to FIG. 7 which illustrates cooperative snap-fastening means 60*d*, 61*d*, both of which are formed from plastic material. The snap-securing means 61*d* and the overall condensation tray (unnumbered) thereof is formed of hollow material, but the chambers are filled with insulation I'. The cooperative snap-securing means 60*d* is also formed from plastic material, is not hollow, and thus carries insulation I' upon an under surface 60*f* thereof.

Figure 8:
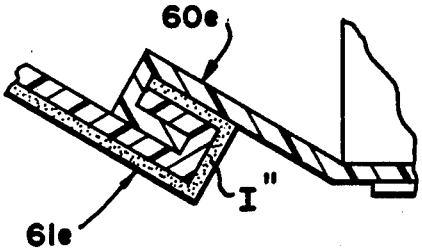
FIG. 8 is a fragmentary cross-sectional view similar to FIG. 7, and illustrates hooks of like configurations absent the condensation collection chambers and insulation of the condensation pan of FIG. 7.

Reference is now made to FIG. 8 in which additional snap-securing means 60*e*, 61*e* are illustrated, both being constructed from flexible metallic material, such as sheet metal. In this case, only snap-securing means 61*e* is provided with a sheet of insulating material I" to preclude the formation of condensation upon the undersurface thereof.

An important feature of the invention is the formation of an air-tight seal between the snap-securing means 40, 41 and 60, 61, for example, upon the same being snap-secured together. The latter occurs by virtue of the insulation I which is sandwiched between the snap-securing means 40, 41 and 60, 61 upon the same being snap-secured together. To achieve optimum sealing the insulation I might be, for example, natural or synthetic rubber in lieu of fiberglass, Rubertex® or the like. Obviously, a similar air-tight seal occurs between the snap-securing means 40*a*, 41*a*; 60*a*, 61*a*: 40*b*, 41*b*; 60*b*, 61*b*: 40*c*, 41*c*; 60*c*, 61*c*: 40', 41'; 60', 61'; 60*d*, 61*d*: 60*e*, 61*e*; and 40", 41"; 60", 61".

Although a preferred embodiment of the invention has been specifically illustrated and described herein, it is to be understood that minor variations may be made in the apparatus without departing from the spirit and scope of the invention, as defined the appended claims.

I claim:

1. A fan coil unit comprising a housing defining a chamber, a condensation pan in said chamber, said condensation pan being constructed from resilient material, means formed from the resilient material of said condensation pan for snap-securing said condensation pan to said housing, and said snap-securing means being a pair of hooks formed of said resilient material with one hook disposed along each of opposite generally parallel sides of said condensation pan.

2. The fan coil unit as defined in claim 1 wherein said snap-securing means constitute the sole means for securing said condensation pan to said housing.

3. The fan coil unit as defined in claim 1 including means generally medially of said condensation pan for rigidifying said condensation pan.

4. The fan coil unit as defined in claim 1 wherein said condensation pan includes interior and exterior surfaces, and chamber means between said interior and exterior surfaces in which condensation is formed because of temperature gradients between said interior and exterior surfaces.

5. The fan coil unit as defined in claim 1 wherein said condensation pan includes interior and exterior surfaces and a chamber therebetween, and insulation within said chamber.

6. The fan coil unit as defined in claim 1 wherein said condensation pan is defined by a pan body and opposite end walls, and said pan body is a hollow extrusion.

7. The fan coil unit as defined in claim 1 wherein said condensation pan is defined by a pan body and opposite end walls, and said pan body is a hollow polymeric/-copolymeric extrusion.

8. The fan coil unit as defined in claim 1 wherein said condensation pan is defined by a pan body and opposite end walls, and said pan body is a hollow aluminum extrusion.

9. The fan coil unit as defined in claim 1 wherein said condensation pan is defined by a pan body and opposite end walls, and said pan body is a hollow metallic extrusion.

10. The fan coil unit as defined in claim 1 wherein said condensation pan is defined by a pan body and opposite end walls, and said pan body is a hollow extrusion of an admixture of polymeric/copolymeric material and a biocide material.

11. The fan coil unit as defined in claim 1 wherein said condensation pan is defined by a pan body and opposite end walls, and said pan body is a hollow stainless steel extrusion.

12. The fan coil unit as defined in claim 1 including means generally exteriorly and medially of said condensation pan for rigidifying said condensation pan.

13. The fan coil unit as defined in claim 1 including means generally exteriorly and medially of said condensation pan for rigidifying said condensation pan, and said rigidifying means has a cross-sectional configuration corresponding to a cross-sectional configuration of said condensation pan.

14. The fan coil unit as defined in claim 1 including means generally exteriorly and medially of said condensation pan for rigidifying said condensation pan, and said rigidifying means has a transverse cross-sectional configuration corresponding to a transverse cross-sectional configuration of said condensation pan.

15. The fan coil unit as defined in claim 1 wherein said pair of hooks open generally toward each other.

16. The fan coil unit as defined in claim 1 wherein said pair of hooks open in generally the same direction.

17. The fan coil unit as defined in claim 1 wherein said pair of hooks open in generally opposite directions.

18. The fan coil unit as defined in claim 1 including a fan board, and means carried by said fan board for cooperative snap securement to said pair of hooks.

19. The fan coil as defined in claim 1 including a fan board, means carried by said fan board for cooperative snap securement to said pair of hooks, and means for generally adjusting the location of said fan board to effect proper relative location and snap-securing action between said pair of hooks and said cooperative snap securement means.

20. The fan coil unit as defined in claim 1 including a fan board and a condensation tray mounting board in generally parallel spaced relationship to each other and defining an elongated gap therebetween, said condensation pan being positioned to generally close said gap, and said fan board and condensation tray mounting board each having means for cooperative snap securement to said pair of hooks.

21. The fan coil unit as defined in claim 1 including a fan board and a condensation tray mounting board in generally parallel spaced relationship to each other and defining an elongated gap therebetween, said condensation pan being positioned to generally close said gap, and said fan board and condensation tray mounting board each having means for cooperative snap securement to said pair of hooks which open in generally the same direction.

22. The fan coil unit as defined in claim 1 including a fan board and a condensation tray mounting board in generally parallel spaced relationship to each other and defining an elongated cap therebetween, said condensation pan being positioned to generally close said gap, and said fan board and condensation tray mounting board each having means for cooperative snap securement to said pair of hooks which open in generally opposite directions.

23. The fan coil unit as defined in claim 20 including means generally medially of said condensation pan for rigidifying said condensation pan.

24. The fan coil unit as defined in claim 20 wherein said condensation pan includes interior and exterior surfaces, and chamber means between said interior and exterior surfaces in which condensation is formed because of temperature gradients between said interior and exterior surfaces.

25. The fan coil unit as defined in claim 20 wherein said condensation pan includes interior and exterior surfaces and a chamber therebetween, and insulation within said chamber.

26. The fan coil unit as defined in claim 20 wherein said condensation pan is defined by a pan body and opposite end walls, and said pan body is a hollow extrusion.

27. A fan coil unit comprising a housing defining a chamber, a condensation pan in said chamber, means carried by said condensation pan for snap-securing said condensation pan to said housing, and means sandwiched between said snap-securing means and said housing for effecting a generally air-tight seal between.

28. The fan coil unit as defined in claim 27 wherein said air-tight seal effecting means is defined by insulating material.

29. The fan coil unit as defined in claim 27 wherein said snap-securing means includes at least one hook.

30. The fan coil unit as defined in claim 27 wherein said snap-securing means includes a pair of hooks between which said air-tight seal effecting means is sandwiched.

* * * * *